United States Patent [19]

Konhäuser et al.

[11] Patent Number: 4,844,347

[45] Date of Patent: Jul. 4, 1989

[54] DEVICE FOR ATOMIZING A LIQUID

[75] Inventors: Peter Konhäuser, Stuttgart; Jurgen Sprenger, Leinfelden-Echterdingen, both of Fed. Rep. of Germany

[73] Assignee: J. Wagner GmbH, Fed. Rep. of Germany

[21] Appl. No.: 172,214

[22] Filed: Mar. 23, 1988

[30] Foreign Application Priority Data

Mar. 24, 1987 [DE] Fed. Rep. of Germany ..... 3709543

[51] Int. Cl.[4] ..... B05B 7/02; B05B 1/04

[52] U.S. Cl. ..... 239/296; 239/300

[58] Field of Search ..... 239/290, 296, 297, 300, 239/601, 705, 299

[56] References Cited

U.S. PATENT DOCUMENTS

| | | | |
|---|---|---|---|
| 1,425,333 | 8/1922 | Parker | 239/300 X |
| 1,751,787 | 3/1930 | Binks | 239/299 |
| 2,271,779 | 2/1942 | Peeps | 239/296 |
| 2,303,280 | 11/1942 | Jenkins | 239/296 |
| 2,304,857 | 12/1942 | Stahl | 239/300 |
| 4,349,153 | 9/1982 | Johnson | 239/296 X |
| 4,645,127 | 2/1987 | Emory et al. | 239/299 |
| 4,713,257 | 12/1987 | Luttermöller | 239/296 X |

*Primary Examiner*—Andres Kashnikow

*Attorney, Agent, or Firm*—Hill, Van Santen, Steadman & Simpson

[57] ABSTRACT

A spray gun for producing an atomized liquid spray jet is provided with fan-shaped shaping air jets which impinge the atomized liquid spray jet to form a fan-shaped atomized liquid spray jet. The shaping air jets are supplied pressurized air which is controlled separately from the atomizer air. The fan-shaped shaping air jets are formed by intersecting air jets, deflected air jets, or air jets emitted from a slotted nozzle.

5 Claims, 2 Drawing Sheets

DEVICE FOR ATOMIZING A LIQUID

BACKGROUND OF THE INVENTION

1. Field of the Invention

The invention pertains generally to devices for pneumatic atomization of liquids to provide atomized liquid spray jets and, more particularly, to a paint sprayer gun nozzle providing a flat spray jet.

2. Discussion of the Related Art

In the art of pneumatic paint spray guns, a liquid to be atomized, generally paint, is supplied to a nozzle nearly underpressurized. Atomizing air is supplied under pressure to an annular gap concentrically surrounding an exit aperture of the nozzle. The liquid emerging from the nozzle aperture is atomized by the pressurized atomizing air streaming from the annular gap.

Due to the shape of the annular gap, the atomized liquid is emitted from the nozzle in the form of a conically expanding spray jet. However, frequently, a flat, fan-shaped spray jet is desired.

In one attempted solution for providing a fan-shaped spray jet, a paint spray gun spray nozzle is provided with two air exit bores or openings, so-called air horns, at opposite sides in front of the nozzle. The air horns are orientated diagonally relative to the nozzle axis to direct air horn jets at a forward slanted direction to thereby compress the conically expanding spray jet to form a flat fan-shaped spray jet. The production of the flat edged spray jet is due to the natural line produced by two intersecting cones; the spray jet and the air horn jet. However, a uniformly flat or planar fan-shaped spray jet is not always produced. Instead, a cross-section of the fan-shaped spray jet includes a thin middle ridge and spreading end regions, i.e. there is a lower concentration of liquid or paint in the middle region than at the end regions.

In another attempted solution, air horns in a sprayer device are provided with a plurality of air exit bores or openings to improve the uniformity of the fan jet. However, this solution has not been entirely successful because the fan-shaped jet produced has a wavy cross-section.

In yet another attempted solution to provide a flat, fan-shaped spray jet, a paint sprayer is provided with limiter air jets which are produced by air exit bores or openings located at opposite sides of the sprayer nozzle or the annular gap for atomizer air. Essentially, the air exit bores or openings direct air jets parallel to the nozzle axis and onto the concially expanding spray jet. The limiter air jets strike the conically expanding spray jet in front of the air horn jets to deform the conically expanding spray jet so that it has an oval cross-section. However, not only is a completely planar fan-shaped spray jet not produced in this attempted solution, the limiter air bores or openings located adjacent to the annular atomizer air gap are generally connected to the atomizer air source. The sole sourcing of atomizer air and limiter air permits only a single optimum operating point which depends upon the degree of atomization desired and does not include means for compensating for the thickness of the fan-shaped spray jet as determined by the air horns, which are usually controlled separately.

Providing a paint sprayer with a plurality with superfine air horn bores and/or limiter air bores involves difficulties in terms of production engineering and entails a risk of blockage due to contamination. Furthermore, while the foregoing discussion is predominantly true for sprayer devices utilizing pneumatic atomization exclusively, it is also true to a degree for devices utilizing combined pneumatic-hydrostatic methods including a hydrostatic middle pressure, a slotted nozzle, and additional compressed air.

SUMMARY OF THE INVENTION

An object of the invention is to provide an improved atomized liquid sprayer device which produces a completely planar fan-shaped spray jet independently of its thickness or density, without a significant structural outlay, and without an increased risk of blockage of air jet openings due to contamination. To achieve the foregoing, a device for pneumatic atomization of a liquid to produce a atomized liquid spray in the form of a fan-shaped spray jet is provided with a pair of shaping air jets symmetrically located on opposite sides of the nozzle axis. Each shaping air jet impacts the conically expanding spray jet on an imaginery line which intersects the nozzle axis to produce a spray jet directed transversely away from the nozzle axis. The shaping air jets are supplied compressed air from a source which is separate from that of the atomizer air.

In accordance with principles of the invention, the shaping air jets are fan-shaped shaping air jets which uniformly compress the conically expanding spray jet to produce a fan-shaped spray jet which is completely planar or flat, i.e., no waviness being apparent in a cross-section of the fan-shaped spray jet. Because the compressed air for the fan-shaped shaping air jets is supplied from a controllable compressed air source separate from that of the atomizer air, it is possible to compress the conically expanding spray jet more or less independently of the atomizer air and to obtain a continuous transition from a circular spray jet cross-section to an extremely flat or linear fan-shaped spray jet cross-section.

In a preferred embodiment of the invention, two air horn jets are each impinged at a defined angle by a fanning air jet to produce the pair of extremely uniform fan-shaped shaping air jets which together uniformly compress the conically expanding spray jet to form a completely flat fan-shaped spray jet. The fan-shaped shaping air jets are significantly more uniform than the air horn jets produced by air horns containing a plurality of individual bores. Moreover, the air horn jets and the fanning air jets exhibit the same amount of energy, i.e., the strengths of the fanning air jets change along with a corresponding change in the strengths of the air horn jets. Therefore, it is possible to guarantee the planarity of the extremely uniform fan-shaped shaping air jets over a wide range, i.e., from a comparatively thick fan-shaped spray jet to an extremely thin fan-shaped spray jet.

These and other objects and aspects will become more apparent by reference to the drawings and the description of the preferred embodiment.

DESCRIPTION OF THE PREFERRED EMBODIMENT

Figure 1:
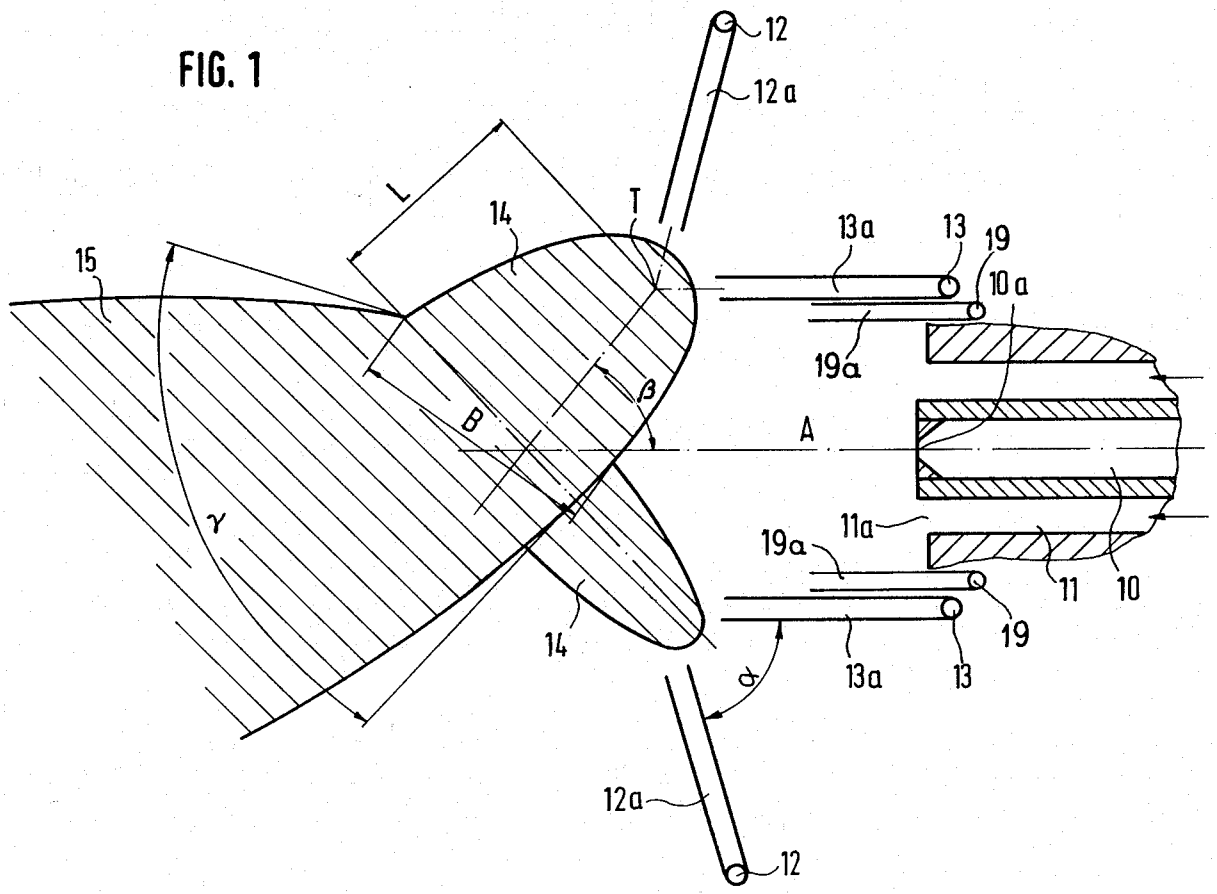
FIG. 1 is a diagramatic representation of a spray gun nozzle embodying principles of the invention including representative air and spray jet patterns produced by various interacting air jets.

In FIG. 1 there is shown a diagramatic representation of a portion of a spray gun including air jets in accordance with principles of the invention. The spray gun includes a delivery channel 10 for delivery of paint or liquid to be sprayed or atomized. The paint or liquid emerges from the channel 10 through an orifice end or nozzle 10*a*. The channel 10 is concentrically surrounded by an annular atomizer air channel 11. Atomizer air emerges from the annular channel 11 through an annular gap 11*a* which concentrically surrounds the nozzle 10*a* to produce a conically expanding spray jet of atomized liquid or paint, not shown.

The spray gun includes air jet bores or openings 12 called air horns which are located symmetrically about a plane containing a nozzle axis A. The air horns 12 emit air horn jets 12*a* at a prescribed forward angle relative to the nozzle axis A.

Two fanning air jet exits or openings 13, so-called air fans, are also located symmetrically about the plane containing the nozzle axis A. The air fans 13 emit fanning air jets 13*a* parallel to the nozzle axis A.

Each of the two air horn jets 12*a* forms a prescribed angle with the fanning air jet 13*a* allocated to it and intersects the fanning air jet 13*a* allocated to it at a point T. The point T lies outside of the spray jet, not shown.

Each air horn jet 12*a* and fanning air jet 13*a* allocated to it converge at their respective points T to form a common fan-shaped shaping air jet 14 which is directed onto the nozzle axis A at a relative angle $\beta$. A common imaginery impact point B of the fan-shaped shaping air jets 14 is shown in FIG. 1. A length L designates the straight path between points T and B. Both of the fan-shaped shaping air jets 14 lie in planes perpendicular to the plane of the drawing of FIG. 1.

If the liquid or paint air and atomizer air are shut off, the two fan-shaped shaping air jets 14 would strike one another to produce a fan-shaped air jet 15, shown in FIG. 1. The fan-shaped air jet 15 would lie in a plane perpendicular to the plane of the drawing of FIG. 1 and would be directed along the nozzle axis A. An angle $\gamma$ in FIG. 1 indicates the angular span of the fan-shaped spray jet, not shown, produced relative to the nozzle axis A given impingement of the spray jet by only one of the shaping air jets 14.

A common compressed air source that is controlled separately from the atomizer air source feeds both the air horns 12 and the air fans 13. Due to the common source of the compressed air, the air intensities produced at the openings 12 and 13 for the air horn jets and the fanning air jets 13*a*, respectively, are identical. Any differences occurring due to unequal guidance deflections and the like can be compensated for by appropriate dimensioning of the bore sizes and/or bore lengths of the openings 12 and 13 with inserts and the like.

A circular section spray jet is produced whenever the compressed air for the air horn jets 12*a* and the fanning air jets 13*a* are disconnected and the liquid or paint air and atomizer air are switched on. When the air horns 12 and the air fans 12 are switched on, the cross-section of the conically expanding spray jet changes continuously with increasing air pressure to an oval shape and then to a pronounced flat fan shape. The greater the angle $\alpha$, the angle $\beta$ or the length L is, the greater the angle $\gamma$ of the paint fan jet becomes. A variation of the slant of the fanning air jets 13*a* and of the air horn jets 12*a* relative to the nozzle axis A while maintaining the angle $\alpha$ constant also leads to a variation of the fan-shaped spray jet angle $\gamma$. Additionally, the more steeply the fan-shaped shaping air jets 14 impinge upon the spray jet, the greater the fan-shaped spray jet angle $\alpha$ becomes.

The formation of the fan-shaped shaping air jets 14, and, thus, the formation of the fan-shaped spray jet becomes more exact the more exactly the air horn jets 12*a* and the fanning air jets 13*a* are focused and guided and the more exactly these jets 12*a* and 13*a* strike one another on their axes. The planarity of the fan-shaped spray jet is thus dependent upon the guided length and precise direction of the air bores 12 and 13 for the air horn jets 12*a* and fanning air jets 13*a*, respectively. It is also essential that the angle $\beta$ be selected to be not greater than 90°. Otherwise, paint blowbacks could occur. Of course, two air horn openings 12 and two air fan openings 13 can be provided at both sides of the nozzle axis A; it having been shown, however, that an adequately planar fan-shaped spray jet is already achievable with one pair of openings 12 and 13 for one air horn jet 12*a* and one fanning air jet 13*a* at opposite sides of the nozzle axis A.

The following dimensions are presented as an example of a preferred embodiment.

Diameter of the paint or liquid nozzle 10*a*: 1.5 mm;
Diameter of the openings of the air horns 12: 1 mm;
Diameter of the openings of the air fans 13: 1 mm;
Distance of the openings of the air fans 13 from the nozzle axis A: 3.5 mm;
Distance of the impact point T from the plane of the end of the nozzle 10*a* in the flow direction: 3.8 mm;
Angle $\alpha$ of inclination of each air horn jet 12*a* relative to each fanning air jet 13*a*: 70°;
Distance of the point B from the nozzle 10*a*: 9 mm; and
Angle $\beta$: 35°.

Further in the preferred embodiment, the pressure of the atomizer air is set to the desired atomization quality depending upon paint or liquid quality and viscosity. The pressure for the air horns 12 and the air fans 13 can be varied between 0 (circular section spray jet) and the maximum network pressure (flattest planar fan-shaped spray jet).

Figure 2:
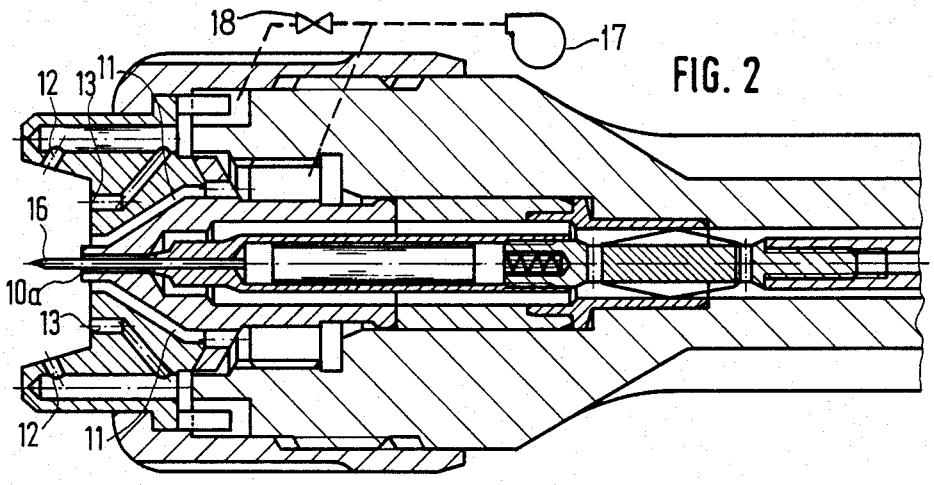
FIG. 2 is a longitudinal cross-sectional view of an embodiment of a spray gun embodying principles of the invention.

In FIG. 2 there is shown a cross-sectional view of a nozzle embodying principles of the invention as described with reference to FIG. 1. The basic structure includes the pneumatic fan jet guns comprising the air horns 12. A drawing can or paint source for the spray gun, not shown, is known and understood by those skilled in the art, and therefore, no additional explanation is provided herein. However, it is noted that the spray nozzle includes a standard needle electrode 16 extending therefrom.

As noted above, the number, direction and size of the openings for the air horns 12 may be varied without departing from the scope of the invention. Additionally, in some cases it may be expedient to provide standard limiter air jet openings 19 with air jets 19*a* (FIG. 1) that strike the spray jet before the air jets 12*a* and 13*a* do to preshape the spray jet. However, this preshaping must not lead to irregularities in the spray jet so that compensation by the air jets 12*a* and 13*a* is no longer possible.

Also shown in FIG. 2 is an air pump 17 for supplying pressurized air to the atomizer air channel 11, the air horns 12 and the air fans 13. A valve 18 inserted into the supply line connecting the pump to the air horn 12 and air fan 13 permits the air horn jet 12*a* and fanning air jet 13*a* to be controlled separately from the atomizer air. Other methods and devices may be used so long as the shaping air jets 14 are separately controlled from the atomizer air. The air supplies are not further shown in FIGS. 3 and 4.

Figure 3:
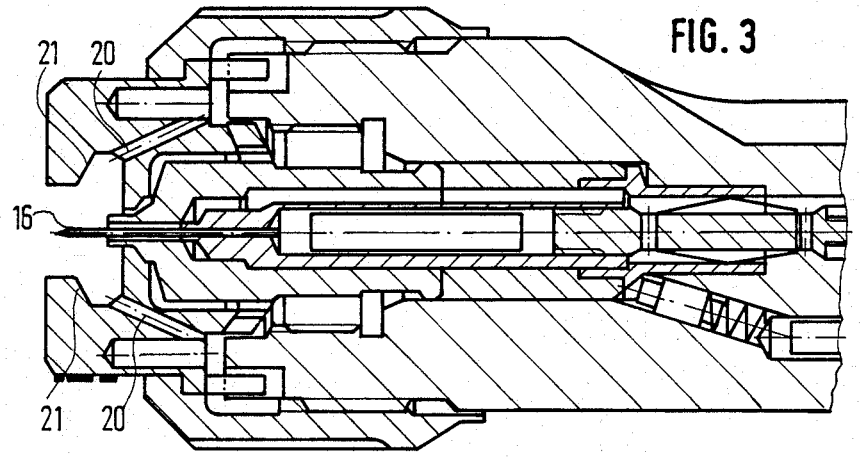
FIG. 3 is a longitudinal cross-sectional view of another embodiment of a spray gun embodying principles of the invention.

In FIG. 3 there is shown an embodiment of the invention that differs from FIG. 2 in that the shaping air jets 14 are not formed by air fans but are formed by air jets emitted from air jet openings 20 and directed against impact surfaces 21 from which the air jets are reflected only to be redirected against the spray jet as fan-shaped shaping air jets 14. Therefore, the fan-shaped shaping air jets 14 in the embodiment of FIG. 2 are formed in a mechanical manner.

Figure 4:
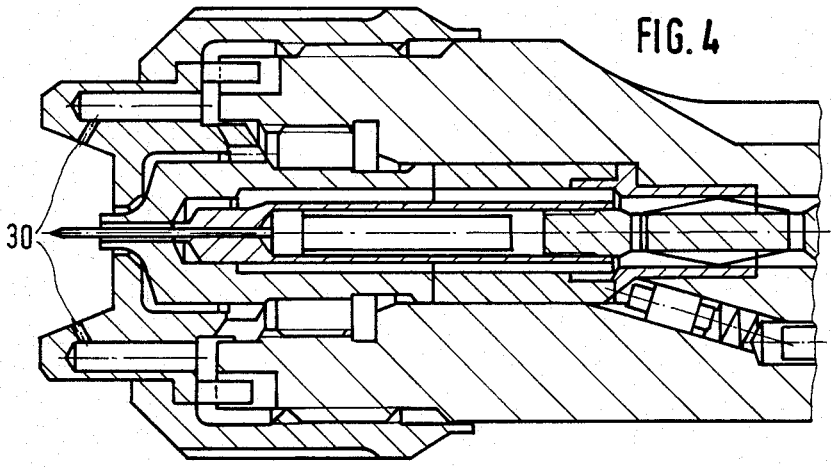
FIG. 4 is a longitudinal cross-sectional view of a third embodiment of a spray gun embodying principles of the invention.

In FIG. 4 there is shown in cross-sectional view another embodiment of the invention in which the air fans 13 are not required. Instead, the shaping air jets 14 are formed by air jets emitted from two slotted nozzles 30. As can be seen, the two slotted nozzles 30 are constructed parallel to one another. With a suitable matching of the air pressure of the resulting shaping air jet and of the length and width of the slotted nozzles 30, it is possible to achieve uniform fan-shaped shaping air jets 14 which are used to compress the spray jet.

While preferred embodiments have been described, modifications and alterations may be apparent to those skilled in the art which fall within the scope and spirit of the invention. It is intended that the attached claims cover those modifications and alterations also.

We claim:

1. An apparatus for producing a fan-shaped atomized liquid spray, comprising:

an atomizer nozzle having a longitudinal axis along which is emitted an atomized liquid spray;

a supply of pressurized air coupled to said atomizer nozzle to provide atmozing air; and two air horn jets each impinged at a defined angle by one of two fanning air jets to provide a pair of extremely uniform fan-shaped shaping air jets located symmetrically on opposite sides of said nozzle axis and directed diagonally forward along imaginary impact lines at angles relative to said nozzle axis, said shaping air jets intersecting at a common point along said nozzle axis, and said shaping air jets being emitted from air jet outlets located about said nozzle axis, said air horn jets and said fanning air jets being supplied with equal amounts of air energy.

2. An apparatus as set forth in claim 1, wherein said shaping air jet outlets are supplied pressurized air which is separately controllable from the atomizing air.

3. An apparatus as set forth in claim 1, wherein said air jets are sharply focused needle jets.

4. An apparatus as set forth in claim 1, further comprising limiter air jets which impinge said atomized liquid spray before said shaping air jets to pre-shape said atomized liquid spray.

5. An apparatus for producing a fan-shaped atomized liquid spray, comprising:

an atomizer nozzle having a longitudinal axis along which is emitted an atomized liquid spray;

a supply of pressurized air coupled to said atomizer nozzle to provide atomizing air; and a pair of fan-shaped shaping air jets located symmetrically on opposite sides of said nozzle axis and directed diagonally forward along imaginary impact lines at angles relative to said nozzle axis, said shaping air jets intersecting at a common point along said nozzle axis, said shaping air jets being emitted from air jet outlets located about said nozzle axis and being supplied pressurized air which is controlled separately from said atomizing air, and said shaping air jets being produced by intersecting air jets each comprising a fanning air jet and an air horn jet, said fanning air jet being directed parallel to and about said nozzle axis, said air horn jet being directed diagonally forward relative to said nozzle axis, said fanning air jet impinging said air horn jet to form said fan-shaped shaping air jet which is directed at an angle onto said atomized liquid spray jet to produce a fan-shaped atomized liquid spray jet.

* * * * *